US005611571A

United States Patent [19]

Manninen et al.

[11] Patent Number: 5,611,571

[45] Date of Patent: Mar. 18, 1997

[54] POLE SHAFT FOR A CROSS-COUNTRY SKI POLE

[75] Inventors: Taisto Manninen; Markku Ripatti; Pauli Jaatinen, all of Mäntyharju, Finland

[73] Assignee: Exel Oy, Mantyharju, Finland

[21] Appl. No.: 501,083

[22] PCT Filed: Feb. 3, 1994

[86] PCT No.: PCT/FI94/00050

§ 371 Date: Sep. 1, 1995

§ 102(e) Date: Sep. 1, 1995

[87] PCT Pub. No.: WO94/17874

PCT Pub. Date: Aug. 18, 1994

[30] Foreign Application Priority Data

Feb. 3, 1993 [FI] Finland ..... 930467

[51] Int. Cl.[6] ..... A63B 53/12

[52] U.S. Cl. ..... 280/819; 135/65

[58] Field of Search ..... 280/819, 821, 280/824, 820; 135/65; 428/36.1, 36.3, 36.4

[56] References Cited

U.S. PATENT DOCUMENTS 5,348,346 9/1994 Unger ..... 280/819

FOREIGN PATENT DOCUMENTS 1809760 5/1970 Germany .
508407 7/1971 Switzerland .

*Primary Examiner*—Richard M. Camby
*Attorney, Agent, or Firm*—Lalos & Keegan

[57] ABSTRACT

The invention relates to a pole shaft for a cross-country ski pole. Longitudinal and transverse fiber layers are used for providing a hollow shaft, whose cross section changes progressively downwards into a droplet shape and, below the mid-way point of a shaft, the length of a droplet shape in relation to its width increases while the cross-sectional area diminishes. By virtue of the droplet shape, the pole can be given more rigidity in skiing direction, whereby the bottom end of a pole can be made lighter while improving the aerodynamics of a pole.

8 Claims, 1 Drawing Sheet

POLE SHAFT FOR A CROSS-COUNTRY SKI POLE

The present invention relates to a pole shaft for a cross-country ski pole, said shaft consisting of resin-bound fiber layers which provide the walls surrounding the continuous cavity of the shaft.

This type of fiber-reinforced pole shafts have been used in cross-country ski poles for a long time. In racing ski poles, the fibers primarily comprise carbon fibers while the general-purpose ski poles usually employ glass fiber or a combination of carbon and glass fibers. The binder resin comprises e.g. an epoxy resin or a polyester resin. It is prior known to make a cross-sectionally circular pole shaft downward tapered so as to place its centre of gravity higher up, i.e. to provide a lightweight lower end and a low air resistance for the lower end. Especially, when using racing ski poles, it is essentially important that a thrust be followed by bringing the pole as quickly as possible forward to a new thrust position. Thus, the weight of the lower end of a pole and the resulting moment of inertia as well as its air resistance must be made as negligible as possible. On the other hand, a pole shaft is required to have a certain strength especially against buckling, which constrains possibilities for the reduction of weight and diameter.

One aspect of the invention is the realization that the hazard of a pole buckling during a thrust is a little more unlikely to occur in lateral direction than backwards in the skiing direction. Thus, the pole can be made a little more flattened in lateral direction than in the skiing direction.

In terms of the position of the centre of gravity, strength, and aerodynamics, the optimum solution is achieved according to the invention in a manner such that the cross-section which is substantially circular or oval at the top end of a shaft gradually changes from the mid-section of a shaft downwards into a droplet shape and in the lower section of a shaft, at least over approximately one third of the length of a shaft, the length of said droplet shape in relation to the width increases while the cross-sectional area diminishes. It is further preferred that adjacent to the lower end of a shaft the droplet shape changes over a short transition zone into a shaft having a substantially circular cross-section and a diameter that is substantially less than the length of said droplet shape. Thus, the sleeve of a snow ring need not be subjected to any modifications as compared to the currently available solutions.

Figure 1:
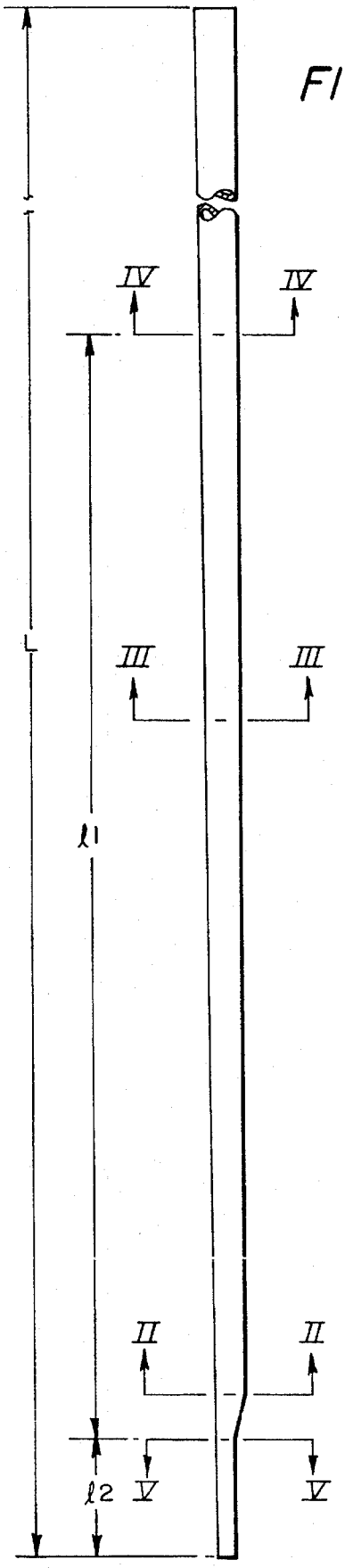
Figure 4:
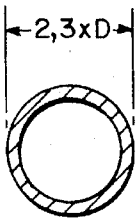
Figure 4A:
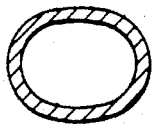

One embodiment of the invention will now be described in more detail with reference made to the accompanying drawing, in which FIG. 1 shows a pole shaft of the invention in a side view and FIGS. 2-5 show sections in a larger scale taken along lines II—II, III—III, IV—IV and V—V in FIG. 1, the numerals for views and sections matching each other. FIG. 4A shows an alternative embodiment of section IV—IV, which is elliptical or oval.

The pole shaft consists e.g. of longitudinal and transverse fiber layers and it is hollow. The walls surrounding the shaft cavity can be of equal thickness or the wall thickness may fluctuate over various sections of the shaft length. In view of optimizing its strength, the position of its centre of gravity, and aerodynamics, the shaft tapers conically and at least in the lower section of the shaft, approximately over ⅓ of a shaft length L, i.e. a distance l 1 (which is e.g. appr. 50 cm), the cross-sectional shape of the shaft changes progressively downwards from a substantially circular or oval cross-section to a droplet shape. The top end of the shaft, at least down to about half-way, can be substantially circular or oval in cross-section. The ratio of the major diameter of an oval cross-section at the top end of the shaft to the minor diameter is not more than 2:1. When progressing down from half-way of the shaft, preferably e.g. over a distance l1, the cross-sectional shape changes gradually more and more towards a droplet shape in a manner such that the length of a droplet shape increases relative to its width. At the same time, the cross-sectional area of the shaft diminishes continuously over the entire shaft length. Thus, for example, the circular or oval-shaped top section is conically tapering while below the mid-way point, especially over a distance l1, the droplet shape stretches to become longer and smaller in cross-section. This change of cross-section is illustrated in FIGS. 2, 3 and 4.

Near the bottom end of the shaft, the droplet shape changes over a short transition zone between section lines I—II and V—V into a shaft of a substantially circular cross-section having a diameter which is substantially smaller than the length of a droplet shape existing above the transition zone. In the most typical case, the circular bottom end has a diameter D which is equal to the width of a droplet shape found immediately above section line II—II. The droplet shape shown in FIG. 2 has a length whose ratio to its width is within the range of 1,5–2,21, preferably about 1,85. Diameter D is e.g. 7–10 mm.

Figure 5:
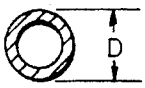

Section IV—IV lies e.g. about 0,5 m above section V–V and section IV–IV is the lowest point at which the cross-sectional shape of the shaft is still circular or oval. Therebelow, the cross-sectional shape turns progressively towards a droplet shape. The ratio of the diameter shown in FIG. 4 to that shown in FIG. 5 is within the range of 2–3, preferably about 2,3. The ratio of the diameter shown in FIG. 4 to the length of the droplet-shape shown in FIG. 2 is within the range of 1,0–1,6, preferably about 1,25. The ratio of the diameter shown in FIG. 4 to the width of the droplet shape shown in FIG. 2 is in turn within the range of 2–3, preferably about 2,3.

Figure 3:
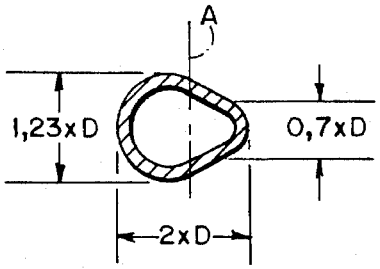
Figure 2:
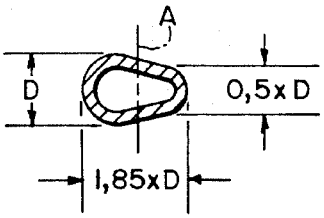

Referring to the droplet shapes shown FIGS. 2 and 3, it can be observed that the droplet-shaped cross-section includes a semi-circular portion, which has a diameter that is equal to the width of the droplet shape and which constitutes the leading end of the droplet shape. When this type of pole shaft is used as a cross-country ski pole, the snow ring and the pole grip must be attached to a pole shaft in a manner such that said leading end of the droplet shape is directed forward in skiing direction. A line A indicates the axis about which a load that causes buckling is distributed in a manner such that the compression stress is in front of axis A and the tensile stress in the back of it. It can be observed that the bottom end of the pole shaft has a strength against the buckling about axis A which is substantially equal to that in the cross-section of FIG. 4. Thus, the centre of gravity of an entire pole shifts upwards and the bottom end of the shaft will be very strong although it is narrow in skiing direction and relatively thin and light in its wall thickness.

We claim:

1. A pole shaft for a cross-country ski pole, said shaft consisting of resin-bound fiber layers which provide walls surrounding a continuous cavity of the shaft, the shaft including a section of its length having a droplet shape cross-section, characterized in that the cross-section, which is substantially circular or oval at the top end of the shaft, gradually changes from the mid-section of the shaft downwards into a droplet shape, and in the lower section of the shaft, at least over approximately ⅓ of the length of the shaft, the length of the droplet shape in relation to its width increases while the cross-sectional area diminishes.

2. A pole shaft as set forth in claim 1, characterized in that the ratio of the length of a droplet shape existing in the bottom end of said shaft to the width thereof is within the range of 1.5:1 to 2.2:1.

3. A pole shaft as set forth in claims 1 or 2, wherein the droplet cross-section changes over a transition zone to a circular cross-section at the bottom end of the pole shaft, and characterized in that the ratio of the diameter of the circular bottom end of the shaft to that of the circular or oval top end of the shaft is within the range of 2:1 to 3:1.

4. A pole shaft as set forth in claims 1 or 2, characterized in that the ratio of the diameter of the top end of the shaft to the length of a droplet shape existing in the bottom end of the shaft is within the range of 1.0:1 to 1.6:1 and to the width of said droplet shape is within the range 2.0:1 to 3.0:1.

5. A pole shaft as set forth in claim 2 wherein said ratio is about 1.85:1.

6. A pole shaft as set forth in claim 3 wherein said ratio of the diameter of the circular bottom end of the shaft to that of the circular or oval top end of the shaft is about 2.3:1.

7. A pole shaft as in claim 3 characterized in that the ratio of the diameter of the top end of the shaft to the length of a droplet shape existing in the bottom end of the shaft is within the range of 1.0:1 to 1.6:1, and to the width of said droplet shape is within the range of 2.0:1 to 3.0:1.

8. A pole shaft as in claim 4 characterized in that the ratio of the diameter of the top end of the shaft to the length of a droplet shape existing in the bottom end of the shaft is about 1.25:1, and to the width of said droplet shape is about 2.3:1.

* * * * *